US006289638B1

(12) United States Patent
Vasseur

(10) Patent No.: US 6,289,638 B1
(45) **Date of Patent: *Sep. 18, 2001**

(54) APPARATUS FOR CREATING A VOID UNDER A STRUCTURAL CONCRETE SLAB

(75) Inventor: Robert Eugene Vasseur, Spruce Grove (CA)

(73) Assignee: Beaver Plastics Ltd., Edmonton (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/413,116

(22) Filed: Oct. 6, 1999

(30) Foreign Application Priority Data

Sep. 14, 1999 (CA) ..... 2282109

(51) Int. Cl.[7] ..... E04R 1/12

(52) U.S. Cl. ..... 52/98; 52/309.1; 248/548; 248/900

(58) Field of Search ..... 52/58, 309.1, 403.1, 52/573.1, 576, 100, 741.15; 248/548, 900, 679

(56) References Cited

U.S. PATENT DOCUMENTS

| | | | | |
|---|---|---|---|---|
| Re. 34,220 | * | 4/1993 | Kennedy et al. | 248/900 X |
| 2,737,693 | * | 3/1956 | Robbins | 52/309.1 X |
| 4,119,387 | * | 10/1978 | Brown | 52/396.06 X |
| 4,362,428 | * | 12/1982 | Kerschner | 52/396.06 X |
| 4,685,267 | | 8/1987 | Workman . | |
| 4,916,878 | * | 4/1990 | Nicholas | 52/396.06 |
| 5,339,578 | * | 8/1994 | Smerchanski et al. | 52/98 |
| 5,352,064 | * | 10/1994 | Carruthers et al. | 52/169.5 X |
| 5,568,994 | | 10/1996 | Dawson . | |
| 5,588,262 | | 12/1996 | Dawson . | |
| 5,699,643 | * | 12/1997 | Kinard | 52/742.14 |
| 5,782,049 | | 7/1998 | Gates et al. . | |
| 5,799,455 | * | 9/1998 | Gates et al. | 52/576 X |

* cited by examiner

*Primary Examiner*—Peter M. Cuomo
*Assistant Examiner*—Hanh V. Tran
(74) *Attorney, Agent, or Firm*—Christensen O'Connor Johnson Kindness PLLC

(57) ABSTRACT

An apparatus for creating a void under a structural concrete slab which includes a body having a bottom surface with projections which deform and then collapse after a preset displacement in response to subgrade compressive stress.

11 Claims, 3 Drawing Sheets

APPARATUS FOR CREATING A VOID UNDER A STRUCTURAL CONCRETE SLAB

FIELD OF THE INVENTION

The present invention relates to an apparatus for creating a void under a structural concrete slab in order to protect the structural concrete slab from heaving caused by the upward movement of underlying ground.

BACKGROUND OF THE INVENTION

Structural concrete slabs often require protection from heaving caused by the upward movement of underlying ground. The preferred approach is to create a void space under the concrete slab. These concrete slabs can be supported at intervals on foundations and void forming materials are used to create void spaces between the concrete slab and the ground. Void forming materials must be able to support the weight of fresh concrete, as well as live loads provided by workmen and equipment during the course of construction. At the completion of construction, the void forming materials must begin to break down in order to protect the concrete from heaving ground.

Void spaces have been constructed using wax-coated cardboard honeycomb products that degrade when exposed to moisture. However, jobsite delays or inclement weather can result in premature strength loss of the cardboard product, causing collapse of the concrete before it is self supporting.

Foam plastic materials, such as expanded polystyrene (EPS) have been substituted for cardboard products, as EPS is not susceptible to the elements. However, used as a compressible inclusion, the stress required to deform the EPS is higher than most concrete slabs can withstand. Various attempts have been made to overcome the problem through the use of light density EPS, resulting in lower compressive strength, and also by creating various shaped voids and configurations in the EPS to reduce the cross sectional area in contact with the soil or the slab. All of these efforts have failed to reduce the pressure on the concrete slab to a level that the slab can withstand.

The industry has, therefore, been searching for many years for a serviceable void forming material for the construction of structural concrete slabs.

SUMMARY OF THE INVENTION

What is required is an alternative apparatus for creating a void under a structural concrete slab.

According to the present invention there is provided an apparatus for creating a void under a structural concrete slab which includes a body having a bottom surface with projections which deform and then collapse after a preset displacement in response to subgrade compressive stress.

The apparatus, as described above, relies on the knowledge that the uplifting forces under the slab occur slowly over a period of time. The projections on the bottom surface of the body are capable of supporting a load during the course of construction. However, in response to subgrade compressive stress the projections deform, eventually collapsing.

There are various configurations of projections that can be configured to collapse after being displaced by a preset amount. Beneficial results have been obtained through the use of bent legs which tend to deform sideways. By placing a bend in the leg, an asymmetrical distribution of the force exerted by subgrade compressive stress can be achieved to deform the legs sideways. By placing a notch at the bend on each of the legs, the legs have a tendency to fracture at the bend which accelerates the collapse of the legs in response to subgrade compressive stress. Each leg goes through an initial loading phase, a creep phase and a collapse phase, as will hereinafter be further described.

There are a variety of materials out of which the body may be made. It is preferred that the material selected be water resistant in order to avoid premature collapse in adverse weather conditions caused by excessive moisture. Beneficial results have been obtained through the use of plastic, as will hereinafter be further described.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 4:
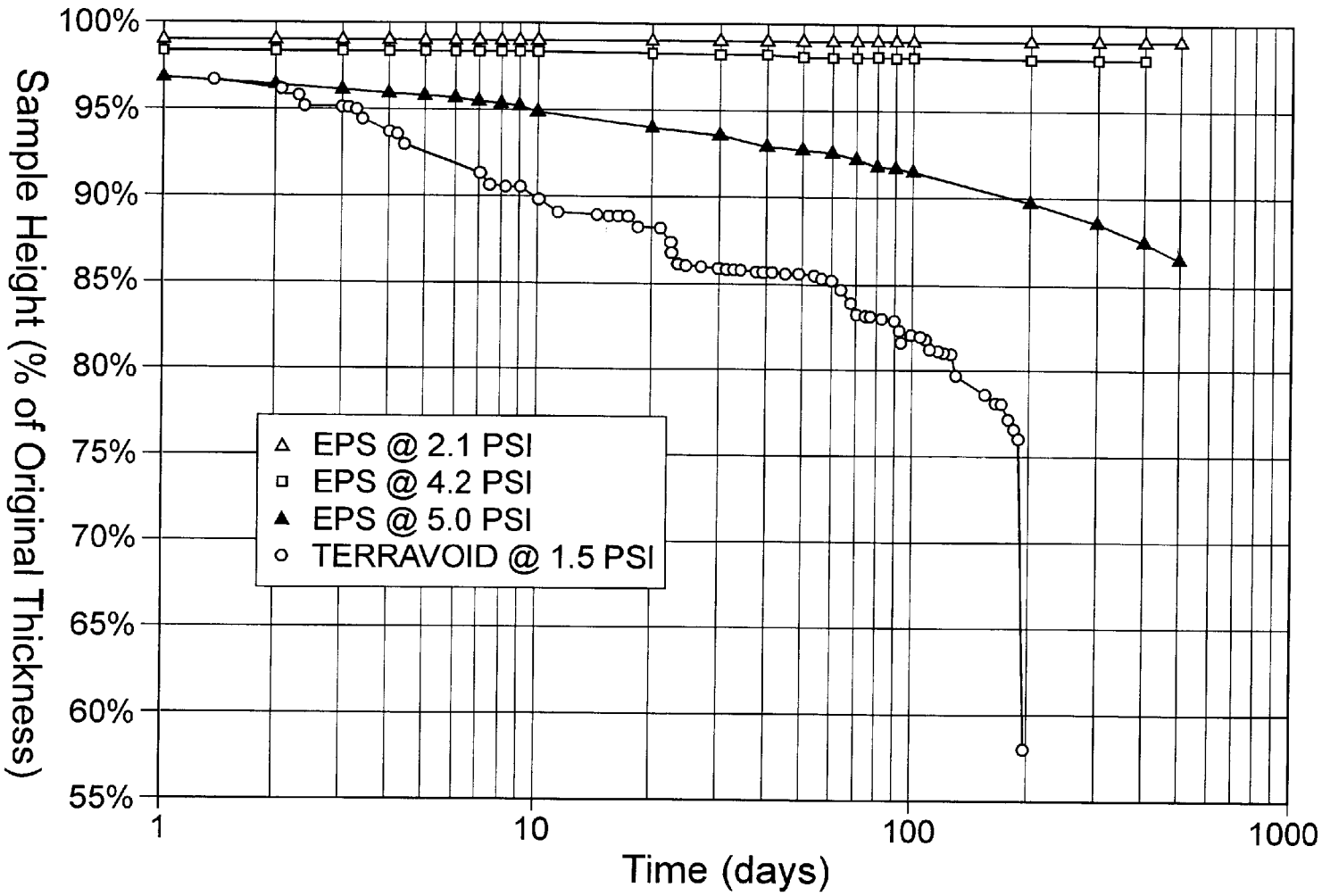
FIG. 4 is a graph showing behaviour of the apparatus, as compared to the prior art.

The preferred embodiment, an apparatus for creating a void under a structural concrete slab generally identified by reference numeral 10, will now be described with reference to FIGS. 1 and 4.

Figure 1:
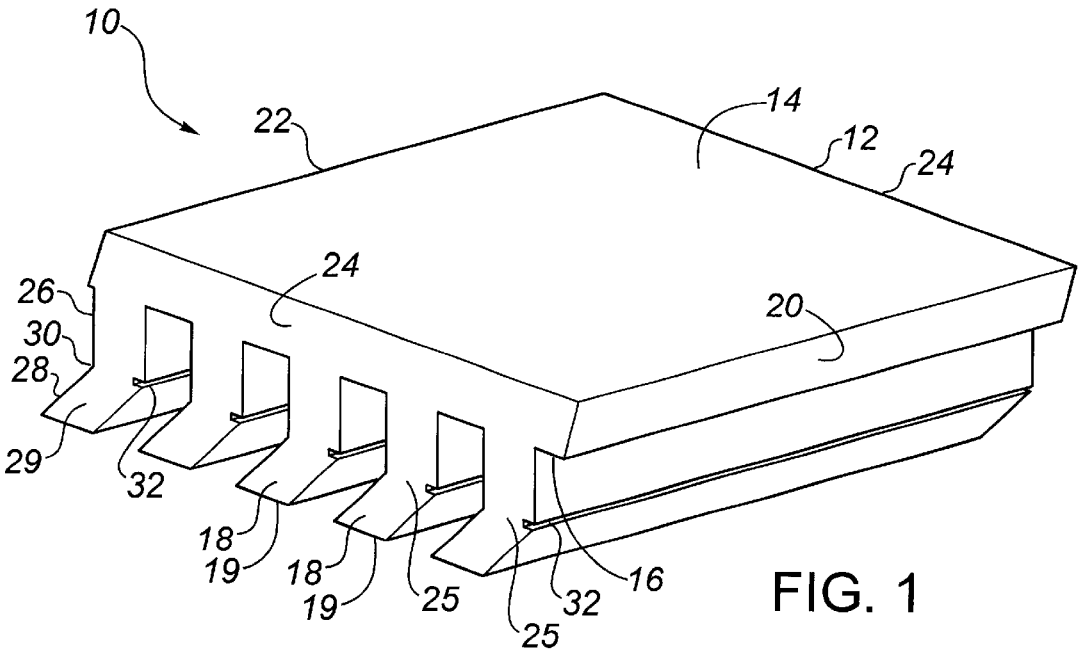
FIG. 1 is a perspective view of an apparatus for creating a void under a structural concrete slab constructed according to the teachings of the present invention.

Referring to FIG. 1, apparatus 10 consists of an expanded polystyrene foam plastic body 12 having a planar top surface 14, a bottom surface 16 with a plurality of depending legs 18, a first end 20, a second end 22, and a pair of opposed sides 24. Each of legs 18 has a same length such that all remote ends 19 of legs 18 together form a base coplanar with top surface 14. Each of legs 18 extends laterally from one of opposed sides 24 to the other of opposed sides 24 in a direction substantially parallel to each of first end 20 and second end 22. Each of opposed ends 29 of each of legs 18 is coplanar with the corresponding one of opposed sides 24 of body 12. Each of legs 18 has a first portion 26 depending at a slight angle from perpendicular from bottom surface 16, and a second portion 28 joined to first portion 26 at a knee portion 30. Each of legs 18 is bent at knee portion 24 toward second end 22.

Figure 2:
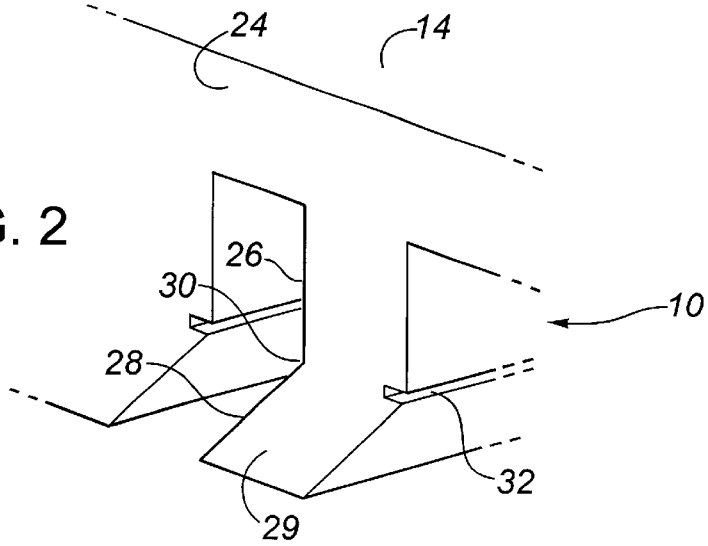
FIG. 2 is a detailed perspective view of the apparatus illustrated in FIG. 1.
Figure 3:
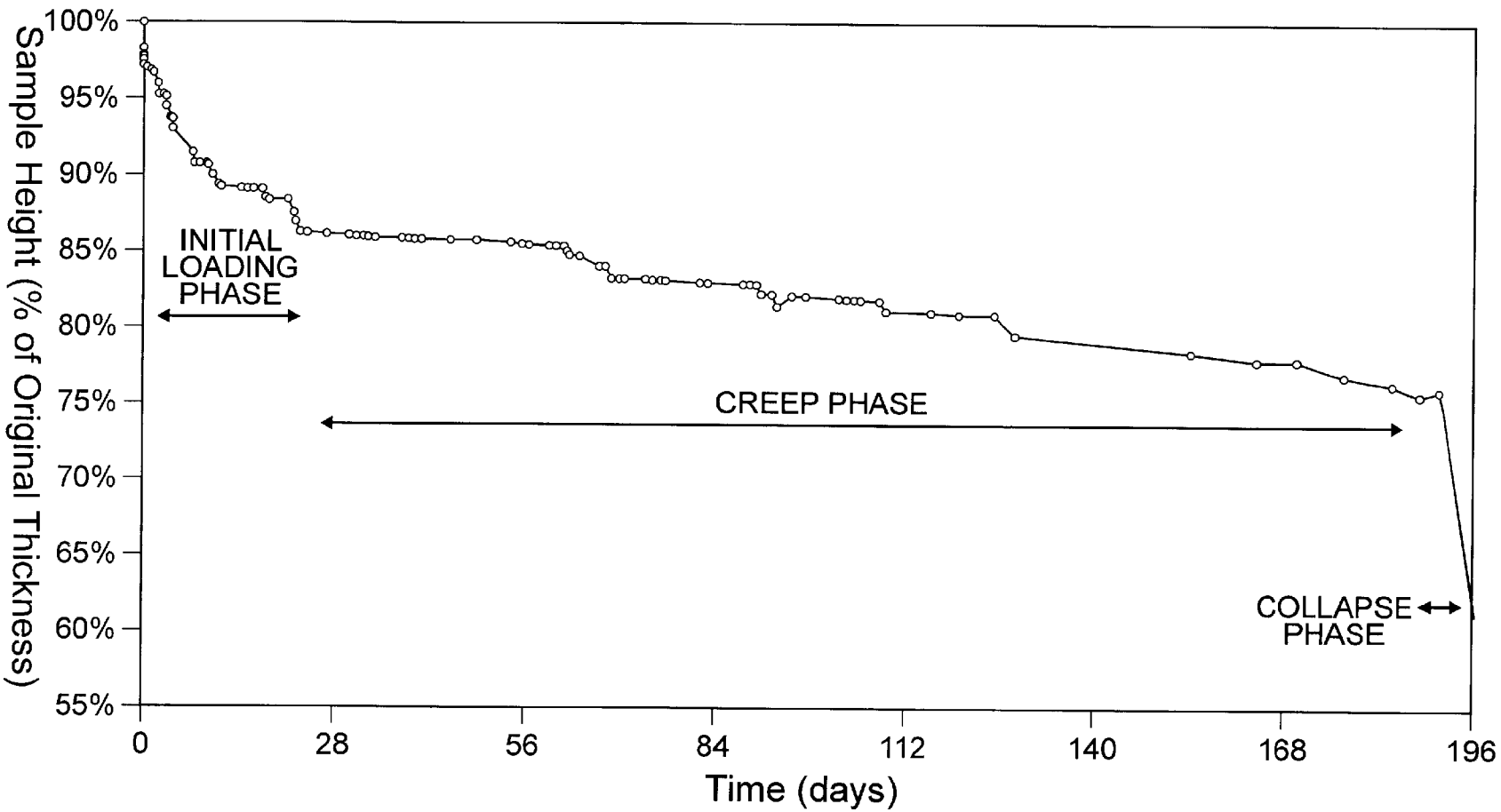
FIG. 3 is a graph showing behaviour of the apparatus.

Referring to FIG. 2, knee portion 24 of each of legs 18 is mechanically weakened with a notch 32. When legs 18 are displaced sideways due to asymmetrical distribution of subgrade compressive stress, each of legs 18 tend to fracture along notch 32 to create an over center collapse upon a preset sideways displacement.

The use and operation of apparatus 10 will now be described with reference to FIGS. 1 through 4. The manner in which apparatus 10 responds to subgrade compressive strength can best be understood with reference to FIG. 3. Apparatus 10 was subjected to pressures of 1.5 pounds per square inch. The test results disclose three identifiable phases. There is an "initial loading phase". There is a "creep phase" during which the projections are being deformed. This is followed by a "collapse phase" during which the projections reach their preset displacement limit and collapse. Referring to FIG. 4, the performance of apparatus 10, is put in context by a comparison with the prior art. The prior art is a conventional EPS slab. It is made of the same material as apparatus 10, but does not have the projections. It will be noted that at pressures of 2.1 pounds per square inch and 4.2 pounds per square inch there is negligible deformation of conventional EPS slabs. As the pressure is increased to 5 pounds per square inch, the EPS slabs begin to deform in response to subgrade compressive forces. However, few structural concrete slabs can withstand forces in this range.

The illustrated embodiment makes use of a combination of a leg that can be described as being eccentric, asymmetrical or bent, combined with a phenomenon of creep inherent in many types of polymer plastic and in EPS foam plastic in particular. It is preferred that the time period for the mechanical collapse be designed around normal strength development for concrete and anticipated subgrade movement. It is believed that there is no other void forming material that can tolerate a moist environment, support a load for an appropriate time during construction and then collapse forming a void space when subjected to subgrade compressive stress.

It will be apparent to one skilled in the art that there are other configurations of projections which can be used. It will also be apparent to one skilled in the art that, in addition to a bend, there are other ways to asymmetrically distribute force exerted by subgrade compressive stress which can be selected to suit a particular configuration of projection. It will further be apparent to one skilled in the art that, in addition to a notch, there are other ways of engineering a structural weakness to promote a fracture of the configuration of projection selected. It will finally be apparent to one skilled in the art that other modifications may be made to the illustrated embodiment without departing from the spirit and scope of the invention as hereinafter defined in the Claims.

What is claimed is:

1. An apparatus for creating a void under a structural concrete slab, comprising:

a planar body having a bottom surface with depending legs, all of the legs being bent to asymmetrically distribute force and having unattached remote ends without appendages that are free to move, such that initial loading at less than maximum load capacity due to subgrade compressive stress serves as a trigger mechanism causing the legs to begin to deform sideways and upon sustained loading the legs continue to deform through a mechanism of creep and then collapse after a preset displacement.

2. The apparatus as defined in claim 1, wherein each of the legs has a notch at an outside of a bend, thereby promoting a fracture of each of the legs at the notch.

3. The apparatus as defined in claim 1, wherein the legs extend for one of the length and the width of the body.

4. The apparatus as defined in claim 1, wherein the body is made from material that is water resistant.

5. The apparatus as defined in claim 4, wherein the material is polymer plastic.

6. The apparatus as defined in claim 5, wherein the plastic is foam plastic.

7. The apparatus as defined in claim 5, wherein the plastic is expanded polystyrene (EPS).

8. An apparatus for creating a void under a structural concrete slab, comprising:

a planar body having a bottom surface with depending legs, each of the legs being bent to asymmetrically distribute force exerted by subgrade compressive stress thereby deforming the legs sideways and having unattached remote ends without appendages that are free to move, such that initial loading at less than maximum load capacity due to subgrade compressive stress serves as a trigger mechanism causing the legs to begin to deform sideways and upon sustained loading the legs continue to deform through a mechanism of creep and then collapse after a preset displacement, a notch being positioned at an outside of a bend on each of the legs, thereby promoting a precisely located fracture and subsequent collapse at the bend.

9. The apparatus as defined in claim 8, wherein the legs extend for one of the length and the width of the body.

10. The apparatus as defined in claim 8, wherein the body is polymer plastic.

11. The apparatus as defined in claim 10, wherein the polymer plastic is an expanded polystyrene foam plastic.

* * * * *